US008229321B2

(12) United States Patent
Kwon et al.

(10) Patent No.: US 8,229,321 B2
(45) Date of Patent: Jul. 24, 2012

(54) IMAGE FORMING APPARATUS INCLUDING GROUNDED CONDUCTIVE MEMBER

(75) Inventors: Eun Young Kwon, Seoul (KR); Jong Hwa Joo, Seoul (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 172 days.

(21) Appl. No.: 12/635,940

(22) Filed: Dec. 11, 2009

(65) Prior Publication Data

US 2010/0158562 A1 Jun. 24, 2010

(30) Foreign Application Priority Data

Dec. 19, 2008 (KR) ..... 10-2008-0130236

(51) Int. Cl.
*G03G 15/00* (2006.01)
*G03G 21/00* (2006.01)
*G03G 21/18* (2006.01)

(52) U.S. Cl. ..... 399/111; 399/98

(58) Field of Classification Search ..... 399/111, 399/113, 118, 98
See application file for complete search history.

(56) References Cited

U.S. PATENT DOCUMENTS

| | | | | |
|---|---|---|---|---|
| 4,540,268 | A * | 9/1985 | Toyono et al. | 399/111 X |
| 4,609,276 | A * | 9/1986 | Mitzutani | 399/111 |
| 4,970,552 | A * | 11/1990 | Okamoto et al. | 399/98 |
| 7,386,248 | B2 * | 6/2008 | Park et al. | 399/113 X |
| 7,627,272 | B2 * | 12/2009 | Iwamura | 399/98 X |
| 2008/0025752 | A1 * | 1/2008 | Suyama et al. | 399/98 |
| 2009/0297213 | A1 * | 12/2009 | Satomura | 399/111 |

FOREIGN PATENT DOCUMENTS

JP 1993-188695 7/1993

* cited by examiner

*Primary Examiner* — Sophia S Chen
(74) *Attorney, Agent, or Firm* — Stanzione & Kim, LLP

(57) ABSTRACT

An image forming apparatus includes a photoconductor, a light scanning unit to irradiate light corresponding to image information, to the photoconductor so as to form an electrostatic latent image, and a developing unit arranged adjacent to an optical path of the light emitted from the light scanning unit and serving to feed developer to the photoconductor on which the electrostatic latent image is formed so as to form a visible image.

25 Claims, 14 Drawing Sheets

FIG. 7B

| | ABS PLASTIC | PET FILM | PAPER | HAND | CONDUCTIVE METAL (Aluminium) |
|---|---|---|---|---|---|
| RESISTANCE | $10e^{14}\Omega$ OR MORE | $10e^{13}\Omega$ OR MORE | $10e^{10}\Omega$ OR MORE | $10e^{6}\Omega$ OR MORE | $10e^{1}\Omega$ OR MORE |
| FUZZ | ERECTED | ERECTED | ERECTED | ERECTED | NOT ERECTED |

IMAGE FORMING APPARATUS INCLUDING GROUNDED CONDUCTIVE MEMBER

CROSS-REFERENCE TO RELATED APPLICATIONS

This application claims priority under 35 U.S.C. §119(a) from Korean Patent Application No. 2008-0130236, filed on Dec. 19, 2008 in the Korean Intellectual Property Office, the disclosure of which is incorporated herein in its entirety by reference.

BACKGROUND

1. Field of the Invention

Embodiments of the present general inventive concept relate to an image forming apparatus having improved light scanning performance.

2. Description of the Related Art

Image forming apparatuses are devised to form an image on a printing medium according to input signals. Examples of image forming apparatuses include printers, copiers, facsimiles, and so-called multi-functional devices that combine some of the functionalities of the aforementioned image forming apparatuses.

In an electro-photographic image forming apparatus, representing a type of image forming apparatus, an electrostatic latent image is formed on a surface of a photoconductor by light emitted from a light scanning unit, and a developer is fed to the electrostatic latent image to thereby form a visible image. The visible image, formed on the photoconductor, is then transferred to a printing medium directly or by way of an intermediate transfer unit and thereafter, is fixed to the printing medium via a fusing process.

FIG. 1 is a side view illustrating a state wherein an optical path of light emitted from a light scanning unit is intercepted by impurities erected by electrostatic induction.

As shown, a member 1 located under the optical path 4 of light emitted from a light scanning unit 2 may be covered with impurities d, such as dust, fuzz, paper powder, etc., floating inside and outside of an image forming apparatus. Some of the impurities d may be erected on the member 1 by electrostatic induction. In this case, the erected impurities d may intercept the optical path 4, thereby preventing a part of the light emitted from the light scanning unit 2 from reaching a photoconductor 3. If a part of the photoconductor 3 is not exposed to the light due to the interception of the optical path 4 caused by the erected impurities d, properly feeding developer to the non-exposed part of the photoconductor 3 may be difficult and this may cause white vertical lines on a printing medium that has completed a printing operation. This printing difficulty may worsen if a shortest distance between a cover of a developing unit and the optical path is 20 mm or less.

SUMMARY

The present general inventive concept provides an image forming apparatus having an improved light scanning performance.

Additional features and/or utilities of the present general inventive concept will be set forth in part in the description which follows and, in part, will be obvious from the description, or may be learned by practice of the general inventive concept.

Exemplary embodiments of the present general inventive concept can be achieved by providing an image forming apparatus that includes a light scanning unit to scan light containing information to be printed, a photoconductor provided in a developing unit, to which the light of the light scanning unit is scanned, and the developing unit having a developing frame to store developer, the developing frame being disposed adjacent to an optical path along which the light of the light scanning unit is introduced, and the developing frame includes a conductive member.

The conductive member may be provided in the developing unit near the optical path along which the light is introduced.

A region of the developing unit disposed below the optical path may be provided with the developer or a developer feed member to feed the developer toward the photoconductor, and at least a part of the conductive member may be located between the optical path and the developer, or between the optical path and the developer feed member in a direction of gravity.

The conductive member may be at least one type selected from a plate, a film, a coating on the developing frame, and a conductive member formed on a part of the developing frame, or combinations thereof.

The conductive member may be grounded.

The conductive member may have a shape corresponding to a shape of an optical path of the light scanned from the light scanning unit.

The image forming apparatus may further include a waste developer collecting unit to collect used developer remaining on the photoconductor, and the waste developer collecting unit may be provided above the developing unit and the light scanned from the light scanning unit may reach the photoconductor via the optical path defined between the waste developer collecting unit and the developing unit.

The conductive member may have a surface resistance of about 10e11Ω or less.

The developing frame of the developing unit may include a base frame in the form of a container to store the developer, and a cover to cover a top of the base frame, and the cover may be inclined by a predetermined angle.

A shortest distance between the cover of the developing unit and an optical path of the light scanned from the light scanning unit is about 10 mm or less.

Exemplary embodiments of the present general inventive concept can also be achieved by providing a developing unit, provided in an image forming apparatus and serving to feed developer to a photoconductor, on which an electrostatic latent image is formed by light scanned from a light scanning unit so as to form a visible image, includes a developing frame including a base frame in the form of a container to store the developer and a cover to cover a top of the base frame, and a conductive member provided at the developing frame to correspond to an optical path of the light scanned from the light scanning unit when mounted in the image forming apparatus.

The conductive member may be provided at the cover.

A region of the developing unit located under the optical path may be provided with the developer or a developer feed member to feed the developer toward the photoconductor, and at least a part of the conductive member may be located between the optical path and the developer, or between the optical path and the developer feed member in a direction of gravity.

The conductive member may be at least one type selected from a plate, a film, a coating on the developing frame, and a conductive member formed on a part or an entirety of the developing frame, or combinations thereof.

The conductive member may be grounded.

The conductive member may have a shape corresponding to a shape of the optical path.

The cover may be inclined by a predetermined angle.

Exemplary embodiments of the present general inventive concept may also be achieved by providing a developing device assembly, provided in an image forming apparatus to feed developer to a photoconductor, on which an electrostatic latent image is formed by light scanned from a light scanning unit so as to form a visible image, includes a developing unit including a developing frame consisting of a base frame in the form of a container to store the developer and a cover to cover a top of the base frame, and a waste developer collecting unit to collect used developer remaining on the photoconductor, and the developing unit further includes a conductive member provided at the developing frame to correspond to an optical path of the light scanned from the light scanning unit when mounted in the image forming apparatus.

The waste developer collecting unit may be provided above the developing unit, and the light scanned from the light scanning unit may reach the photoconductor via an optical passage defined between the waste developer collecting unit and the developing unit.

Exemplary embodiments of the present general inventive concept may also be achieved by providing a developing unit of an image forming apparatus having a photoconductor to receive light from a light scanning unit, the developing unit including a developing frame having a container to store developer and at least one conductive portion disposed thereon, wherein the conductive portion is disposed to prevent impurities from interfering with the light of the light scanning unit.

The conductive portion may be disposed below an optical path between the light scanning unit and the photoconductor.

The developing frame may include a cover to cover the container.

The cover may be inclined with respect to the image forming apparatus to allow gravity to move the impurities disposed thereon away from the optical path.

An area of the conductive portion may correspond to an area of the optical path.

Exemplary embodiments of the present general inventive concept may also be achieved by providing a developing unit of an image forming apparatus having a photoconductor to receive first and second lights from a light scanning unit, the developing unit including a developing frame having a container to store developer and first and second conductive portions disposed on the developing frame to respectively correspond to the first and second lights, wherein the first and second conductive portions are disposed to prevent impurities from interfering with the first and second lights of the light scanning unit.

The first conductive portion may be disposed below a first optical path of the first light between the light scanning unit and the photoconductor, and the second conductive portion may be disposed below a second optical path of the second light between the light scanning unit and the photoconductor.

The developing frame may include a cover to cover the container.

The cover may be inclined with respect to the image forming apparatus to allow gravity to move the impurities disposed thereon away from the first and second optical paths.

An area of the first conductive portion may correspond to an area of the first optical path, and an area of the second conductive portion may correspond to an area of the second optical path.

BRIEF DESCRIPTION OF THE DRAWINGS

These and/or other features and utilities of the present general inventive concept will become apparent and more readily appreciated from the following description of the exemplary embodiments, taken in conjunction with the accompanying drawings of which:

FIG. 7B is an experimental table illustrating surface resistances of covers made of different materials and a status of fuzz on surfaces of the covers;

DETAILED DESCRIPTION OF THE EMBODIMENTS

Figure 1:
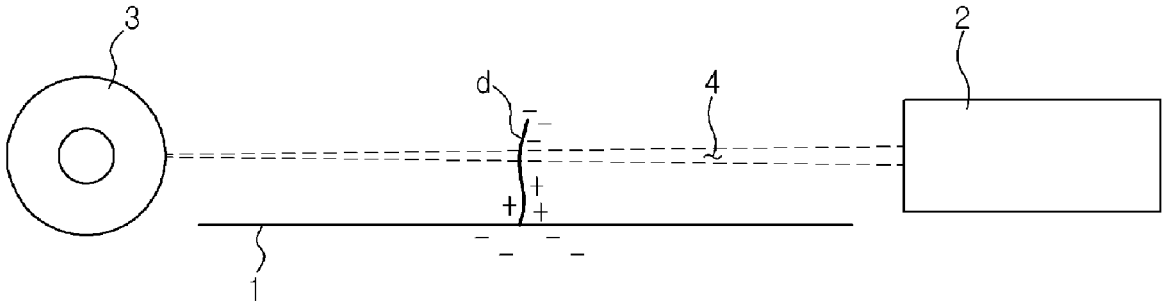
FIG. 1 (RELATED ART)
FIG. 1 is a side view illustrating a state wherein an optical path of light emitted from a light scanning unit is intercepted by impurities erected by electrostatic induction according to the conventional art.

Reference will now be made in detail to the embodiments of the present general inventive concept, examples of which are illustrated in the accompanying drawings, wherein like reference numerals refer to the like elements throughout.

Figure 2:
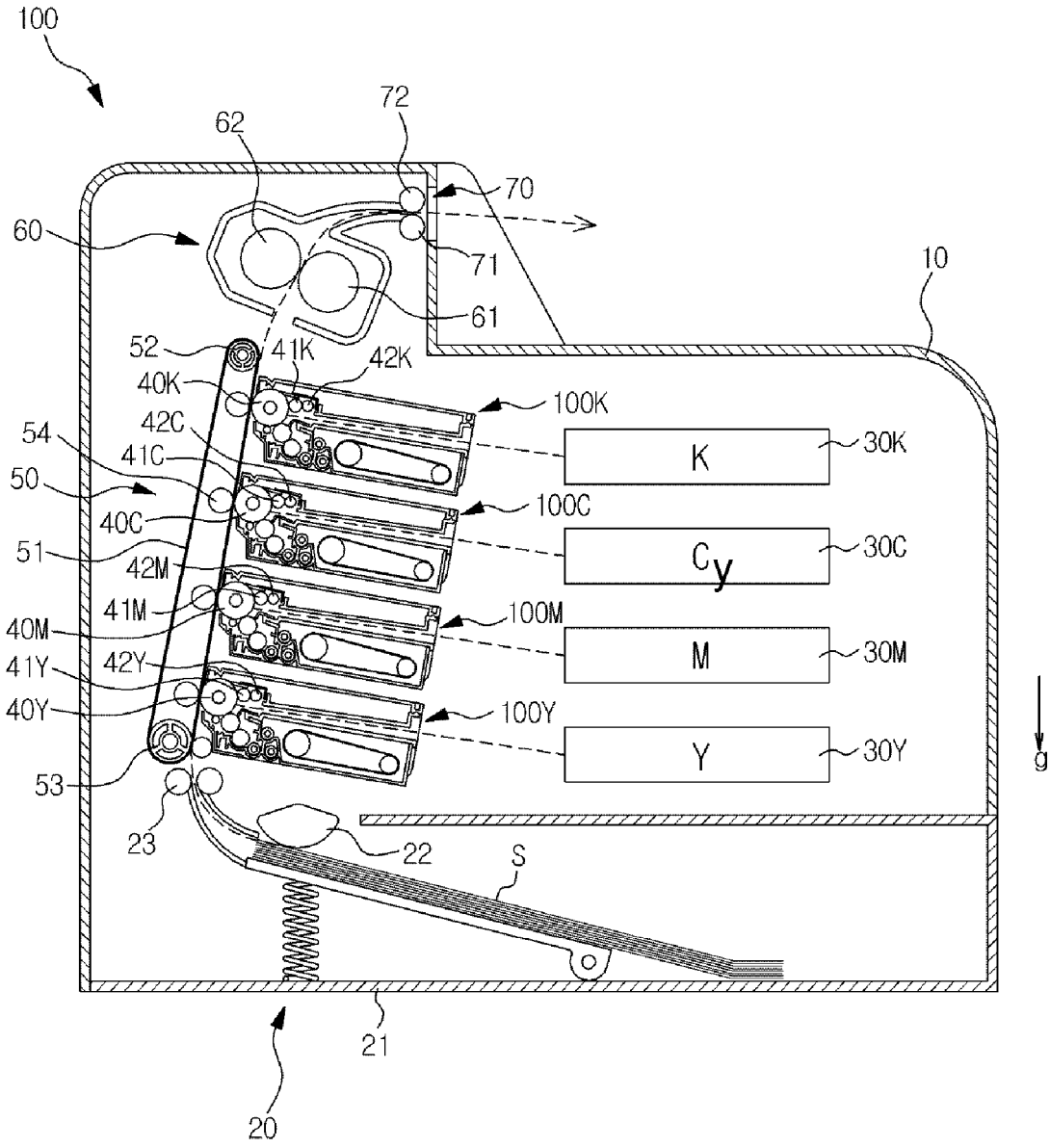
FIG. 2 is a sectional view illustrating an image forming apparatus according to an exemplary embodiment of the present general inventive concept.

FIG. 2 is a sectional view illustrating an image forming apparatus 100 according to an exemplary embodiment of the present general inventive concept.

The image forming apparatus 100 includes a body 10, a printing medium supply unit 20, light scanning units 30Y, 30M, 30C, and 30K, photoconductors 40Y, 40M, 40C, and 40K, developing units 100Y, 100M, 100C, and 100K, a transfer unit 50, a fusing unit 60, and a printing medium discharge unit 70.

The body 10 defines an exterior appearance of the image forming apparatus 100 and supports a variety of constituent elements installed therein.

The printing medium supply unit 20 includes a cassette 21 in which printing media S is stored, a pickup roller 22 to pick up the printing media S stored in the cassette 21 sheet-by-sheet, and delivery rollers 23 to deliver the picked-up printing medium S toward the transfer unit 50.

The light scanning units 30Y, 30M, 30C, and 30K scan light, corresponding to image information of yellow (Y), magenta (M), cyan (Cy), and black (K) colors, to the photoconductors 40Y, 40M, 40C, and 40K that will be described hereinafter, based on print signals.

The photoconductors 40Y, 40M, 40C, and 40K are charged with a predetermined electric potential by charging devices 41Y, 41M, 41C, and 41K, before light is scanned from the light scanning units 30Y, 30M, 30C, and 30K. With the light scanned from the light scanning units 30Y, 30M, 30C, and 30K, electrostatic latent images are formed on surfaces of the respective photoconductors 40Y, 40M, 40C, and 40K. Reference numerals 42Y, 42M, 42C, and 42K indicate cleaning devices used to clean the charging devices 41Y, 41M, 41C and 41K.

The developing units 40Y, 40M, 40C, and 40K feed different colors of developers, for example, yellow (Y), magenta (M), cyan (C), and black (K) developers to the corresponding photoconductors 40Y, 40M, 40C, and 40K, so as to form visible images on the surfaces of the respective photoconductors 40Y, 40M, 40C, and 40K. The developing units of the present exemplary embodiment will be described later in more detail.

The transfer unit 50 includes a paper delivery belt 51 to be driven by a driving roller 52 and a driven roller 53, and a plurality of transfer rollers 54 located inside the paper delivery belt 51. However, the present general inventive concept is not limited thereto. In exemplary embodiments, the transfer rollers 54 may be arranged opposite the respective photoconductors 40Y, 40M, 40C, and 40K and function to transfer the developer on the photoconductors 40Y, 40M, 40C, and 40K onto the printing medium, S such as paper.

The fusing unit 60 includes a heating roller 61 having a heater, and a press roller 62 arranged opposite the heating roller 61. When the printing medium S passes between the heating roller 61 and the press roller 62, an image is fixed to the printing medium S by heat transmitted from the heating roller 61 and a force, such as pressure, acting between the heating roller 61 and the press roller 62.

In exemplary embodiments, the printing medium discharge unit 70 includes a paper discharge roller 71 and a backup roller 72 and serves to discharge the printing medium, having passed through the fusing unit 60, to an area outside of the body 10.

Figure 3:
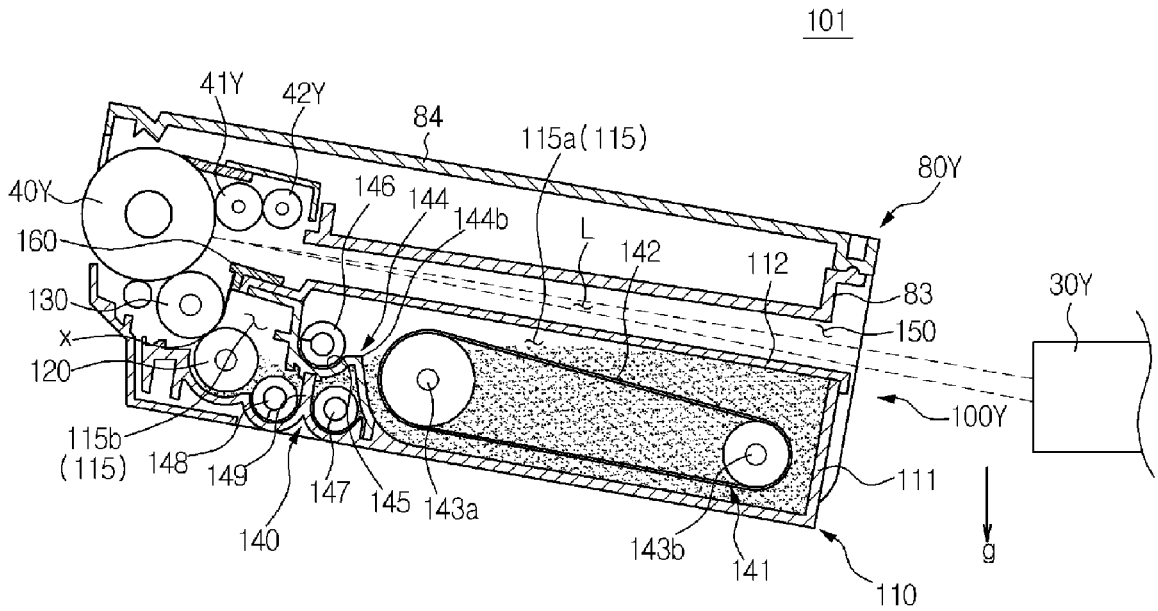
FIG. 3 is a sectional view illustrating a photoconductor, a developing unit, and a waste developer collecting unit according to the exemplary embodiment of FIG. 2.
Figure 4:
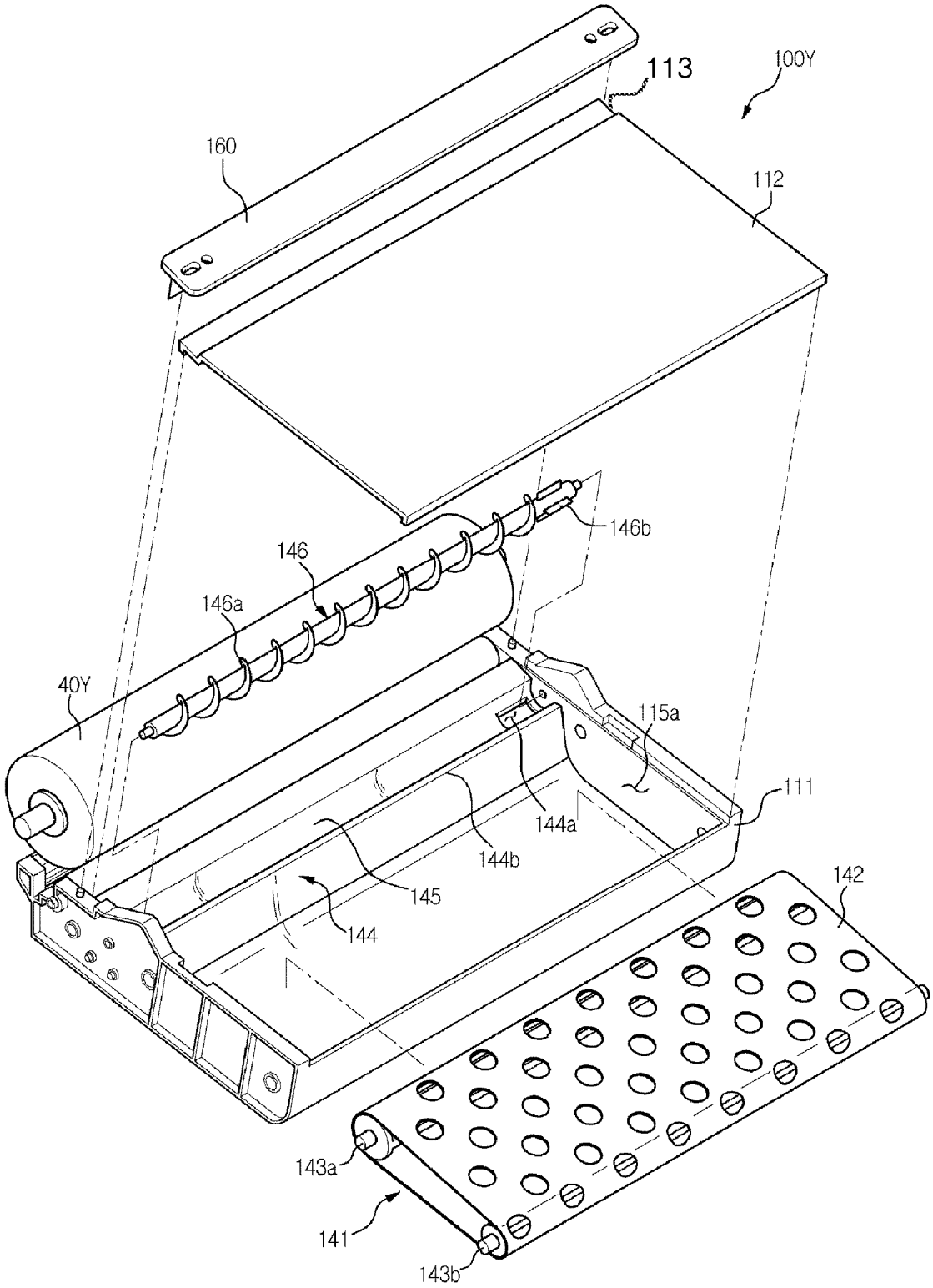
FIG. 4 is an exploded perspective view illustrating the photoconductor and developing unit according to the exemplary embodiment of FIG. 2.
Figure 5:
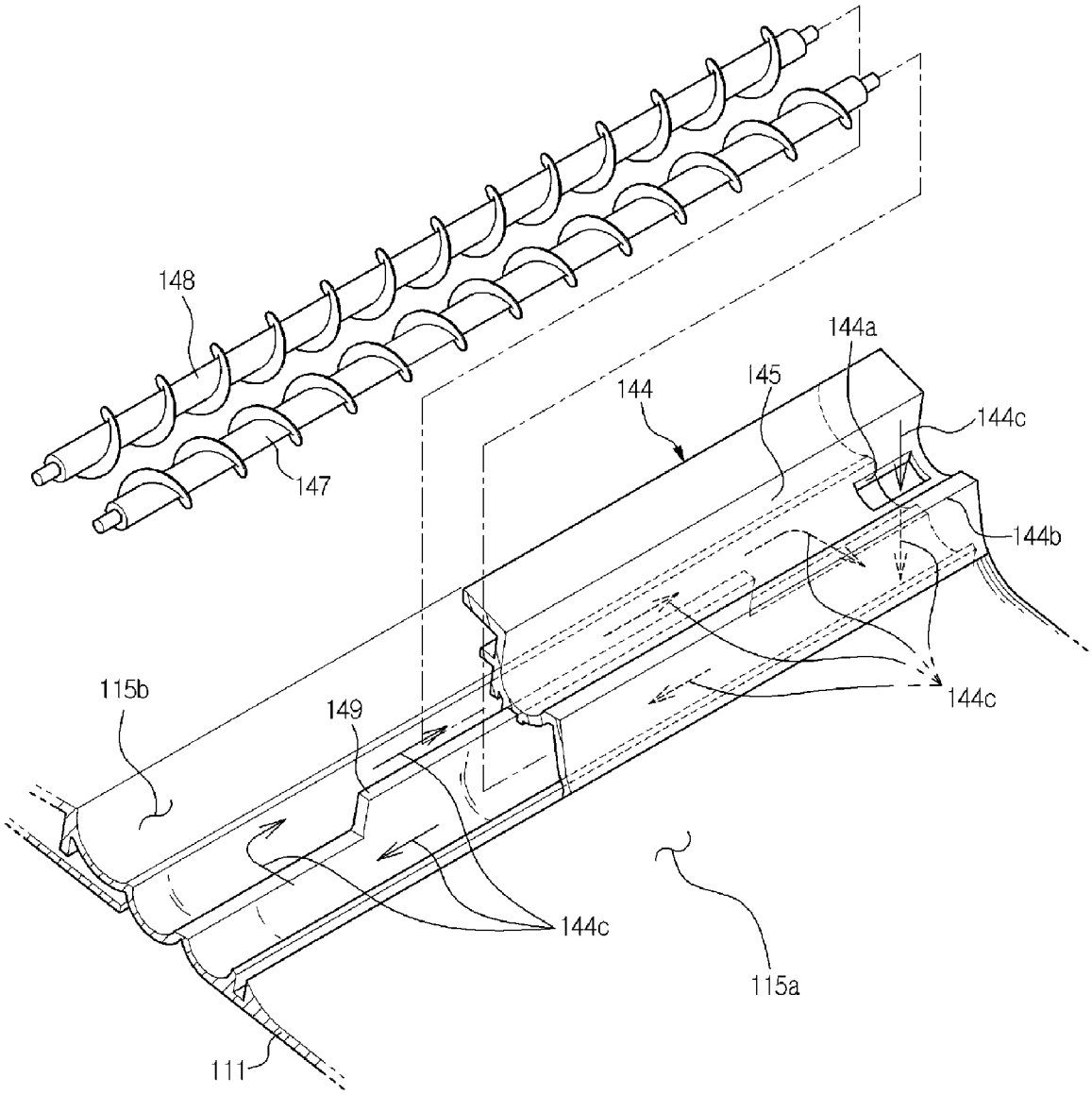
FIG. 5 is a partial sectional view illustrating a developer delivery path in the developing unit according to the exemplary embodiment of FIG. 2.
Figure 6:
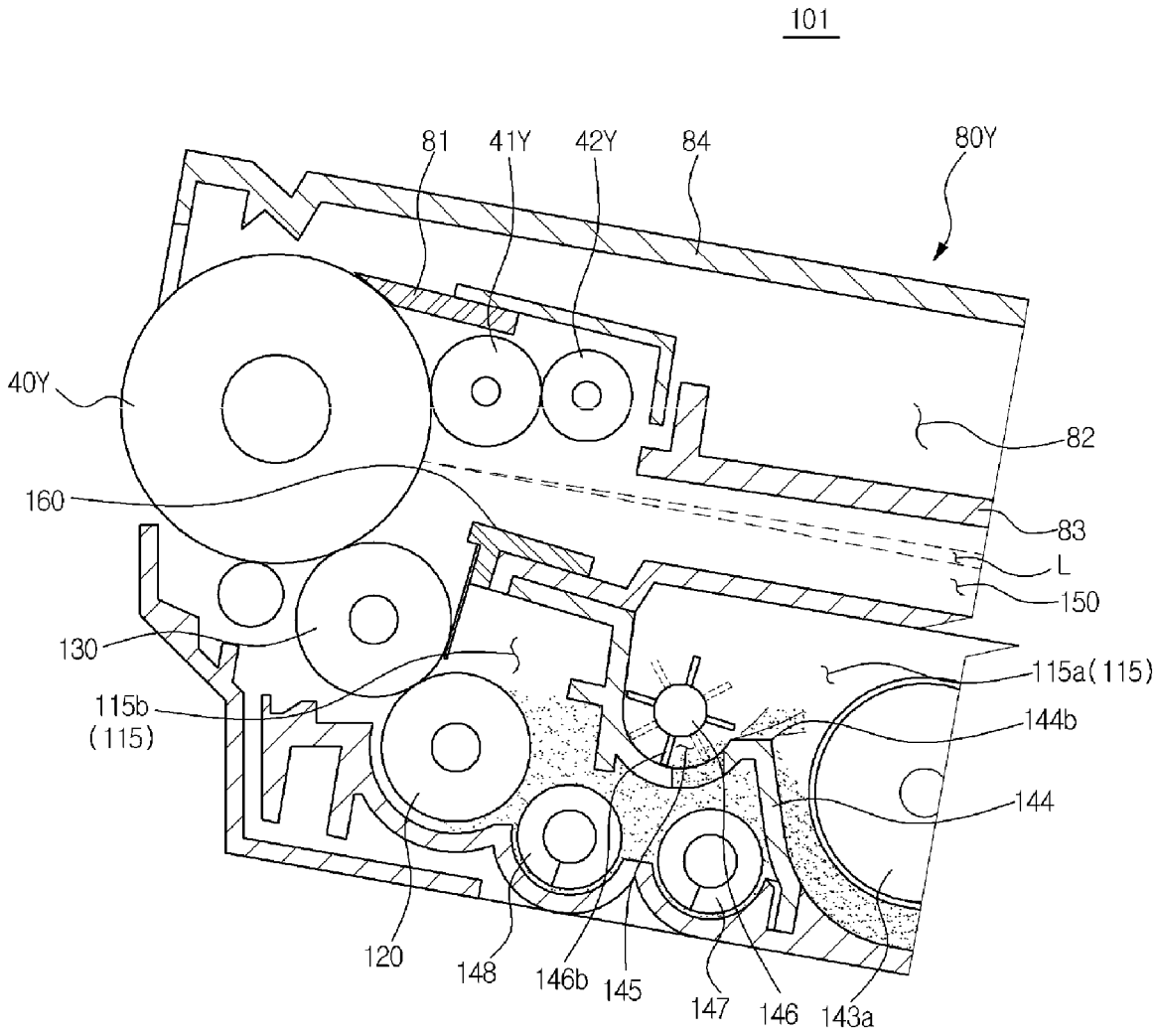
FIG. 6 is a sectional view illustrating an operation to return developer from a temporary storage portion of a partition in a state wherein a sufficient amount of developer is fed into a second developer receiving chamber of the developing unit according to the exemplary embodiment of FIG. 2.

FIG. 3 is a sectional view illustrating the photoconductor, the developing unit, and a waste developer collecting unit according to the exemplary embodiment of FIG. 2. FIG. 4 is an exploded perspective view illustrating the photoconductor and the developing unit according to the exemplary embodiment of FIG. 2. FIG. 5 is a partial sectional view illustrating a developer delivery path in the developing unit according to an exemplary embodiment. Also, FIG. 6 is sectional a view illustrating an operation to return developer from a temporary storage portion of a partition according to the exemplary embodiment in a state wherein a sufficient amount of developer is fed into a second developer receiving chamber of the developing unit.

Although the developing unit 100Y in which yellow (Y) developer is received will be described hereinafter by way of example, it will be appreciated that the following description is applicable to the other three developing units 100M, 100C and 100K although this is not specially mentioned.

As illustrated in FIG. 3, the image forming apparatus 100 of the present general inventive embodiment includes a developing device assembly 101 including the photoconductor 40Y, the developing unit 100Y, and a waste developer collecting unit 80Y.

As illustrated in FIGS. 3 to 6, the developing unit 100Y includes a base frame 111 in the form of a container to store a developer and a cover 112 to cover a top of the base frame 111, wherein both the base frame 111 and the cover 112 define a developer receiving chamber 115 in which the developer is received.

The developing unit 100Y of the present exemplary embodiment includes a partition 144. In exemplary embodiments, the partition 144 divides the developer receiving chamber 115 into a first developer receiving chamber 115*a* and a second developer receiving chamber 115*b*. In exemplary embodiments, the first developer receiving chamber 115*a* and second developer receiving chamber 115*b* may be in communication with each other through an inlet 144*a* (see FIGS. 4 and 5) perforated through one side of the partition 144. However, the present general inventive concept is not limited thereto.

The developer stored in the first developer receiving chamber 115*a* may be fed upward in the first developer receiving chamber 115*a* by a belt device 141 to thereby be fed to a developer temporary storage portion 145 defined by the partition 144. After the developer, fed to the developer temporary storage portion 145, is delivered to one side of the partition 144 by an axial-delivery blade 146*a* of a feed auger 146, the developer falls into the second developer receiving chamber 115*b* through the inlet 144*a* perforated through one side of the developer temporary storage portion 145 by gravity.

In exemplary embodiments, the fallen developer is then circulated along a direction 144*c* by circulating augers 147 and 148 with a circulating partition wall 149 interposed therebetween. With this circulation process, the developer is fed to a developing member 130 by way of a feed member 120 under the influence of a frictional charging force. The developing member 130 attaches the developer to the surface of the photoconductor 40Y on which the electrostatic latent image is formed by the light scanning unit 30Y, thereby forming a visible image. In this case, a regulating member 160 regulates a layer of the developer applied to an outer peripheral surface of the developing member 130. The first and second circulating augers 147 and 148, feed member 120 and developing member 130 of the present exemplary embodiment constitute a developer feed device, which is given by way of example and serves to feed the developer toward the photoconductor 40Y. However, the developer feed device of present general inventive concept is not limited thereto. In alternative exemplary embodiments, the feed device may be omitted in a binary developing type using developer and a carrier.

Once a sufficient amount of the developer is fed into the second developer receiving chamber 115*b*, introduction of the developer through the inlet 144*a* is stopped. As illustrated in FIG. 6, a part of the developer, having not been introduced into the inlet 144*a*, is returned toward the belt device 141 by a radial-delivery blade 146*b* of the feed auger 146.

The belt device 141 includes a delivery belt 142 and a pair of drive shafts 143*a* and 143*b* to drive the delivery belt 142. In exemplary embodiments, of the two drive shafts 143*a* and 143*b*, a center of the drive shaft 143*a* located closer to the feed auger 146 may be located lower than a rotating center of the feed auger 146 in the direction of gravity g (see FIG. 3). In addition, a rotator (not illustrated) located on the drive shaft 143*a* closer to the feed auger 146 may have a larger rotating radius than a rotating radius of a rotator (not illustrated) located on the drive shaft 143*b* located farther from the feed auger 146. In addition, the drive shaft 143*a* closer to the feed auger 146 may be positioned higher than the drive shaft 143*b* farther from the feed auger 146 in the direction of gravity g. This arrangement enables an efficient adjustment of a feed amount of the developer.

Now, a reason why the developing unit 100Y employs the delivery belt 142 in the present exemplary embodiment will be described. Conventionally, a plurality of agitators is substantially horizontally arranged toward a feed member, to feed developer toward the feed member. In a color image forming apparatus wherein a plurality of developing units are substantially vertically stacked above one another similar to the present exemplary embodiment, it may be necessary to reduce a height of each developing unit for the purpose of reducing an overall height of the image forming apparatus and thus, it may be necessary to reduce a rotating radius of the agitators within the developing unit. However, the smaller the rotating radius of the agitators, the smaller a rotating radius of the developer being delivered and consequently, the smaller a delivery span of the developer. In other words, the smaller the height of the developing unit, the smaller the rotating radius of the agitators and it may be necessary to provide a sufficient number of agitators for efficient delivery of the developer. However, feeding the developer by way of a large number of agitators may apply an excessive force (i.e., stress) to the developer. Further, an increased number of agitators results in a complicated configuration including a complicated drive force transmission mechanism to drive the agitators. Therefore, provided that the delivery belt is used to feed the developer in the present exemplary embodiment, there is no need for a plurality of agitators, and even if the developing unit has a small height, the developing unit at least provides rotation of the pair of drive shafts thus resulting in a simplified configuration. In addition, elimination of the complicated drive force transmission mechanism eliminates forces applied to the developer.

As described above, the partition 144, which separates the first developer receiving chamber 115*a* from the second developer receiving chamber 115*b*, includes the developer temporary storage portion 145 surrounding the bottom of the feed auger 146, and the inlet 144*a* is perforated through one side of the developer temporary storage portion 145. In this case, to prevent the developer, delivered into the second developer receiving chamber 115*b*, from being accumulated higher than a nip region x between the developing member 130 and the feed member 120, the inlet 144*a* perforated through the partition 144 may be located under the nip region x between the developing member 130 and the feed member 120 in the direction of gravity g. However, the present general inventive concept is not limited thereto.

The inlet 144*a* may have a rectangular or elliptical shape and may be located close to a longitudinal distal end of the rotating feed auger 146. However, the present general inventive concept is not limited thereto. That is, in alternative exemplary embodiments, the inlet 144*a* may include various other shapes and may be disposed in various locations along the partition 144, as desired. However, in the case where the feed auger 146 is replaced by a mixing agitator or any other delivery members having a feed function, the inlet 144*a* may be perforated in only one side, or the inlet 144*a* may take the form of a longitudinally extending slit. However, the present general inventive concept is not limited thereto. That is, in alternative exemplary embodiments, a configuration wherein a plurality of slits is longitudinally spaced apart from one another may be also possible.

In exemplary embodiments, an end 144*b* of the developer temporary storage portion 145 toward the belt device 141 may be positioned lower than the rotating center of the feed auger 146 to prevent an excessive amount of the developer from being fed into the developer temporary storage portion 145 (see FIG. 3).

In FIG. 3, reference numeral 160 indicates the regulating member to uniformly regulate a layer of the developer applied to the developing member 130.

As illustrated in FIG. 4, the feed auger 146 includes the spiral axial-delivery blade 146*a* and the radial-delivery blade 146*b*. The spiral axial-delivery blade 146*a* generates an axial delivery force to deliver the developer, fed to the developer temporary storage portion 145, to the inlet 144*a* perforated through one side of the partition 144. The radial-delivery blade 146*b* generates a radial delivery force to return a part of the developer having not been introduced into the inlet 144*a* to the belt device 141.

Although the present exemplary embodiment employs auger type feed devices, such as the feed auger 146 and first and second circulating augers 147 and 148, the present general inventive concept is not limited thereto. That is, in alternative exemplary embodiments, in addition to the auger type elements, any other developer feed member, developer agitating member and developing mixing member may be also used. In this case, peripheral configurations may be changeable according to shapes of the respective members, and this change may be equally applicable by those of ordinary skill in the art.

A shield member to shield the inlet 144*a* in an initial state of the developing unit 100Y may be provided. In exemplary embodiments, the shield member may take the form of a film to allow a user to pull and remove the film, or may be configured to open or close the inlet 144*a* in linkage with a surrounding rotating device (for example, the feed auger or circulating auger). In alternative exemplary embodiments, the shield member may be provided with an elastic device (not illustrated) to enable an elastic opening or closing operation, and with a guide member (not illustrated) to guide movement of the shield member.

In the present exemplary embodiment, the feed member 120 or the developing member 130 takes the form of a cylindrical roller, wherein a conductive shaft is centrally located and a conductive rubber roller portion surrounds a periphery of the conductive shaft. However, the present general inventive concept is not limited to the roller shape, and therefore in exemplary embodiments, a belt type or brush type may be also applicable. The feed member 120 and the developing member 130 are arranged opposite to each other and are rotated while defining a nip region x therebetween. Specifically, the feed member 120 and developing member 130 are rotated in opposite directions on the basis of the nip region x, thereby generating frictional charging force to frictionally charge the developer to allow the developer to be delivered to the developing member 130. Of course, an appropriate amount of power may be applied to the feed member 120 and the developing member 130 to electrically deliver the developer, in addition to using the frictional charging force. In exemplary embodiments, if DC power is applied, an absolute value of power applied to the developing member 130 must be smaller than an absolute value of power applied to the feed member 120, to allow for an easy electric delivery of the developer.

With the above-described configuration and operation, a partition may assure successive feeding and consumption of the developer in the developing unit of the present exemplary embodiment thus resulting in even print quality and enhanced developer use efficiency. More particularly, in the developing unit of the present exemplary embodiment, if the developer is deteriorated by temperature and pressure around the developing member 130 and the feed member 120, the partition 144 prevents the deteriorated developer from being returned into the first developer receiving chamber 115*a* and allows successive consumption of the developer around the developing member 130 and feed member 120, thereby assuring consistent print quality. In addition, this also prevents highquality developer from being mixed with the deteriorated developer and becoming useless, resulting in an enhanced developer use efficiency.

The developing unit according to the present exemplary embodiment may maintain an appropriate amount of the developer received in the second developer receiving chamber 115*b* without a separate sensor member. More specifically, if the developer in the second developer receiving chamber 115*b* accumulates in the vicinity of the inlet 144*a*, the developer may not be fed further through the inlet 144*a*, but may be returned to the belt device 141 thus allowing the developer received in the second developer receiving chamber 115*b* to always maintain a predetermined level.

As illustrated in FIG. 3, the waste developer collecting unit 80Y serves to collect developer remaining on the photoconductor 40Y to prevent the waste developer from being transferred onto the printing medium. For this, the waste developer collecting unit 80Y includes a cleaning blade 81 to scrape the waste developer remaining on the surface of the photoconductor 40Y, and a waste developer receiving chamber 82 in which the collected waste developer is received. Reference numerals 83 and 84 indicate frames defining the waste developer receiving chamber 82.

The waste developer collecting unit 80Y is located above the developing unit 100Y. Light emitted from the light scanning unit 30Y reaches the photoconductor 40Y through an optical passage 150 defined between the waste developer collecting unit 80Y and the developing unit 100Y. Thus, the light emitted from the light scanning unit 30Y is adjacent upward to the frame 83 of the waste developer collecting unit 80Y and downward to the cover 112 of the developing unit 100Y.

The cover 112 of the developing unit 100Y according to the present exemplary embodiment constitutes a developing frame 110 together with the base frame 111. The cover 112 may include a conductive member having a low surface resistance. In this case, to assure an easy electrical discharge of the cover 112 of the developing unit 100Y, the cover 112 of the developing unit 100Y may be grounded using a grounding member (not illustrated) when the developing unit 100Y is mounted in the image forming apparatus 100. Of course, in exemplary embodiments, an additional conductive member may be provided at the base frame 111.

Figure 7A:
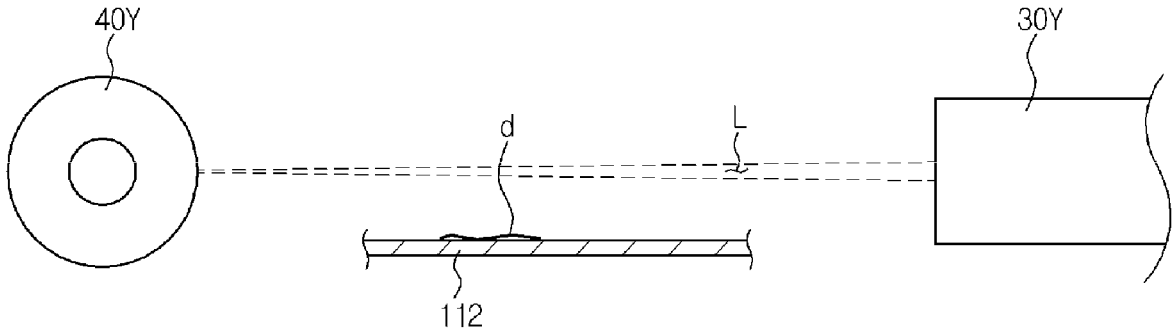
FIG. 7A is a side view illustrating the status of impurities on a cover of the developing unit according to the exemplary embodiment of FIG. 2.

Accordingly, in the image forming apparatus 100 of the present exemplary embodiment, the cover 112 of the developing unit 100Y is not easily charged by, e.g. friction and thus, may achieve enhanced light scanning performance. More specifically, in the case where the cover 112 of the developing unit 100Y contains a conductive member having a low surface resistance so as not to be easily charged, even if the cover 112 of the developing unit 100Y is covered with elongated impurities d, such as dust, fuzz, etc., the impurities d tend to lie on the cover 112 rather than standing erect thereon (see FIG. 7A). This prevents the impurities d, such as dust, fuzz, etc., from intercepting an optical path L between the light scanning unit 30Y and the photoconductor 40Y, thus resulting in enhanced light scanning performance.

In particular, even if a minimum distance between the cover 112 of the developing unit 100Y and the optical path L is 20 mm or less, the relatively long impurities may be prevented from standing erect by electrostatic induction and thereby intercepting the optical path L. This also contributes to reduction in a size of the developing unit and consequently, the image forming apparatus.

Of course, the cover 112 of the developing unit 100Y containing the conductive member may restrict electrostatic attraction between the cover 112 and the impurities thus assuring easy removal of the impurities from the cover 112. In particular, the cover 112 of the developing unit 100Y according to the present exemplary embodiment may be inclined by a predetermined angle in a state wherein the developing unit 100Y is mounted in the image forming apparatus 100 (see FIG. 2). Therefore, the impurities d on the cover 112 of the developing unit 100Y may be easily removed even by a slight stream of air and a possibility of the impurities d intercepting the optical path L is further reduced.

FIG. 7B is an experimental table illustrating surface resistances of covers made of different materials and the status of elongated fuzz on surfaces of the covers.

As illustrated in the experimental table of FIG. 7B, a non-conductive member, such as Acrylonitrile Butadiene Styrene (ABS) plastic and a Polyethylene Terepthalate (PET) film, causes fuzz to stand erect, and paper having a surface resistance of $10e^{11}\Omega$ does not cause fuzz to stand erect. Accordingly, in exemplary embodiments, the cover 112 of the developing unit 100Y may be made of a material having a surface resistance of or $10e^{11}\Omega$ less.

Figure 8:
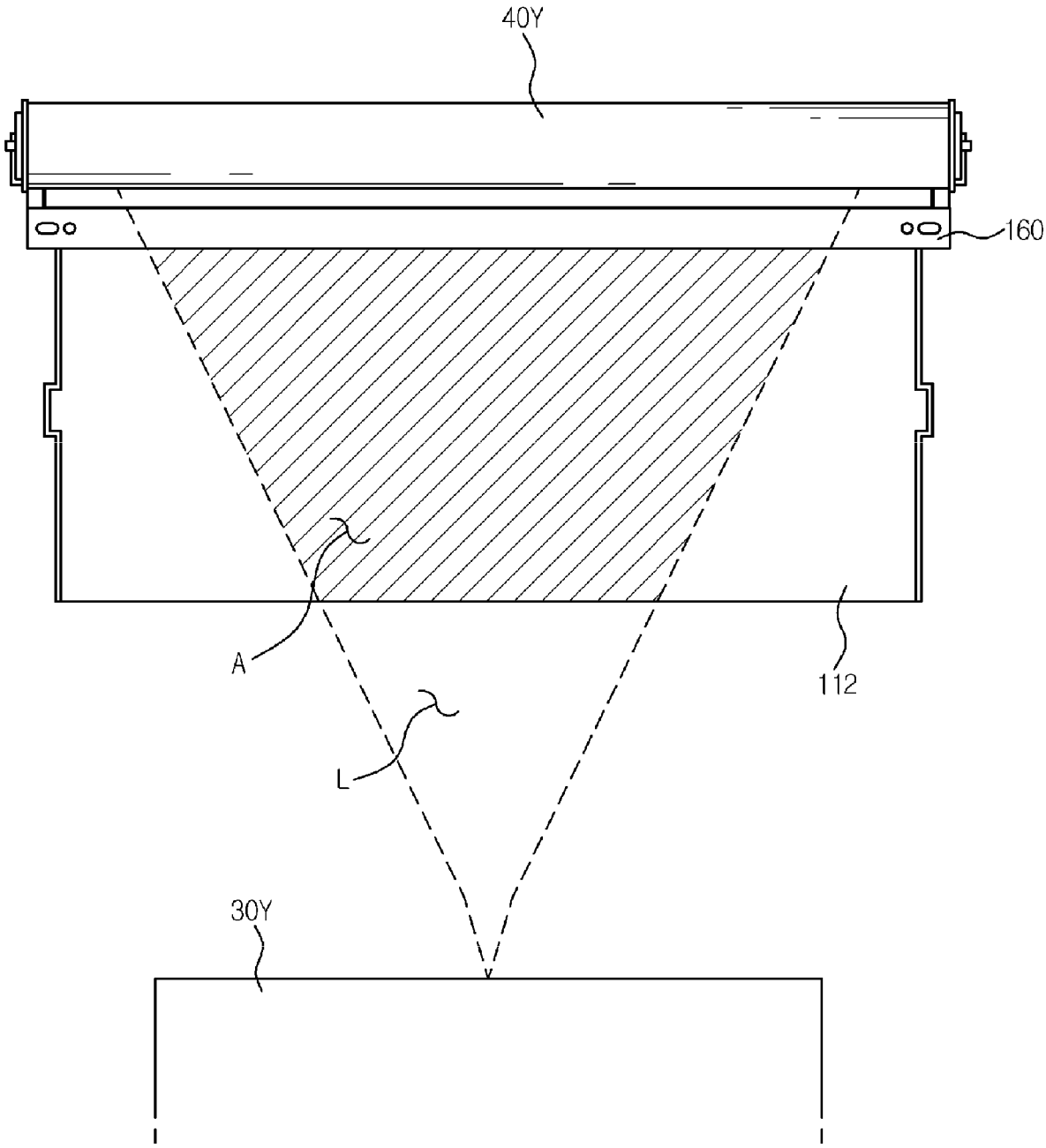
FIG. 8 is a top plan view illustrating an optical path of light scanned from a light scanning unit according to an exemplary embodiment.
Figure 9:
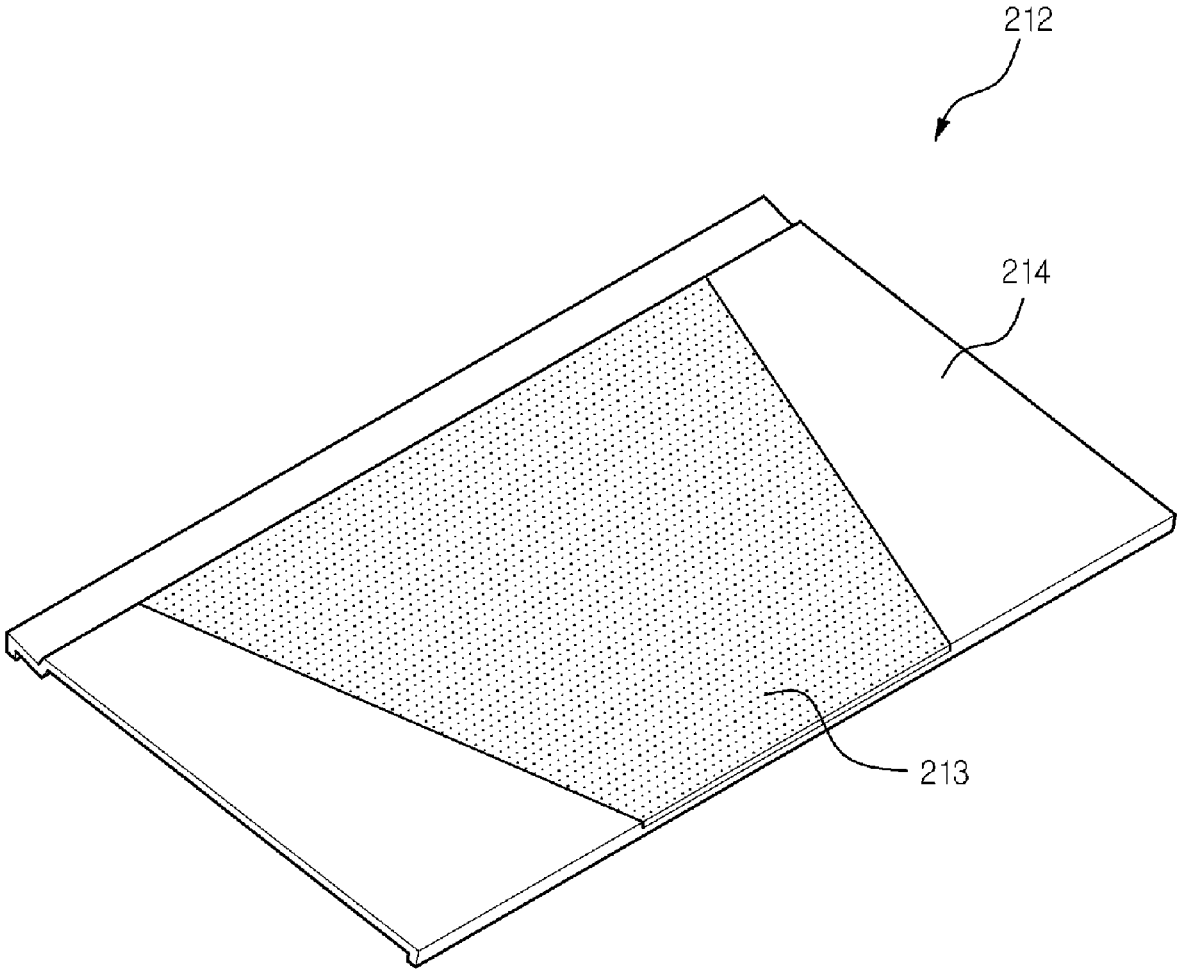
FIGS. 9, 10, and 11A are perspective views illustrating covers for the developing unit according to alternative exemplary embodiments of the present general inventive concept.

For reference, the cover 112 of the developing unit 100Y according to the present exemplary embodiment is wholly or partially made of a conductive material and thus, the entire cover 112 functions as an anti-charge part. However, as illustrated in FIGS. 8 and 9, since the light emitted from the light scanning unit 30Y passes over a region A of the cover 112 of the developing unit 100Y, the anti-charge part made of a conductive member may be formed only in the region A of the cover 112 corresponding to the optical path L. In this case, the anti-charge part may have an area sufficient to cover the optical path L. Also, the anti-charge part may be grounded using a grounding member 113 in a state wherein the developing unit 100Y is mounted in a body 10 of the image forming apparatus 100.

The cover 112 is located above developer storage and feed regions of the developing unit 100Y. More specifically, the cover 112 or the conductive anti-charge part provided at the cover 112 is located between the optical path L, along which the light is introduced, and at least a part of, e.g., the belt device 141, feed member 120 and developing member 130 which function to feed the developer toward the photoconductor 40Y.

Referring now to FIG. 9, a cover 212 of the developing unit 100Y may include an anti-charge part 213 made of a conductive plastic, and a cover frame 214 made of ABS plastic, which are coupled to each other by double injection molding. However, this configuration is given by way of example, and the constituent materials and coupling method of the anti-charge part 213 and cover frame 214 are not specially limited thereto. That is, in alternative exemplary embodiments, the anti-charge part 213 may be a conductive metal plate, and may be attached to the cover frame 214 by means of, e.g., double sided tape, screws or the like.

Figure 10:
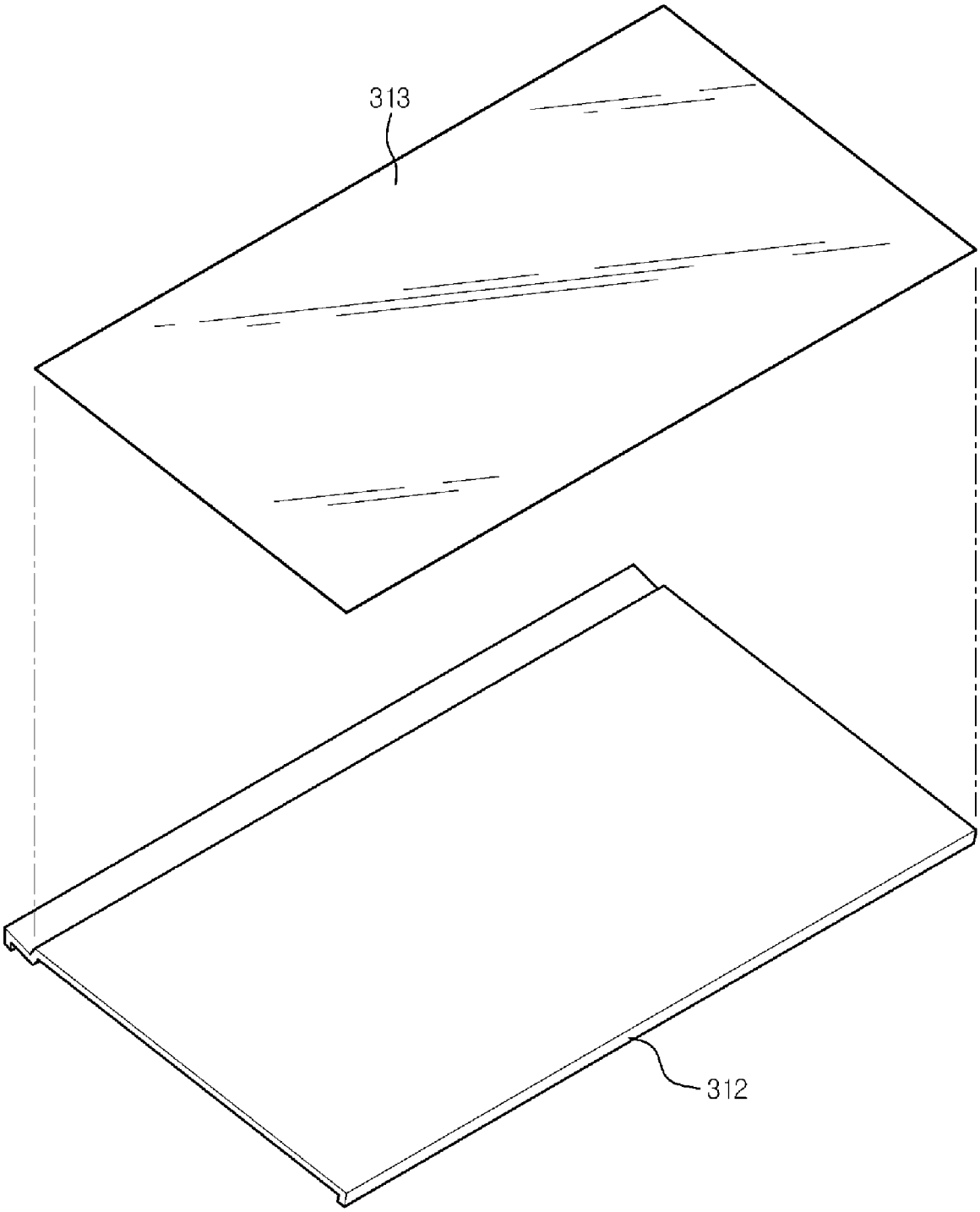
Figure 11A:
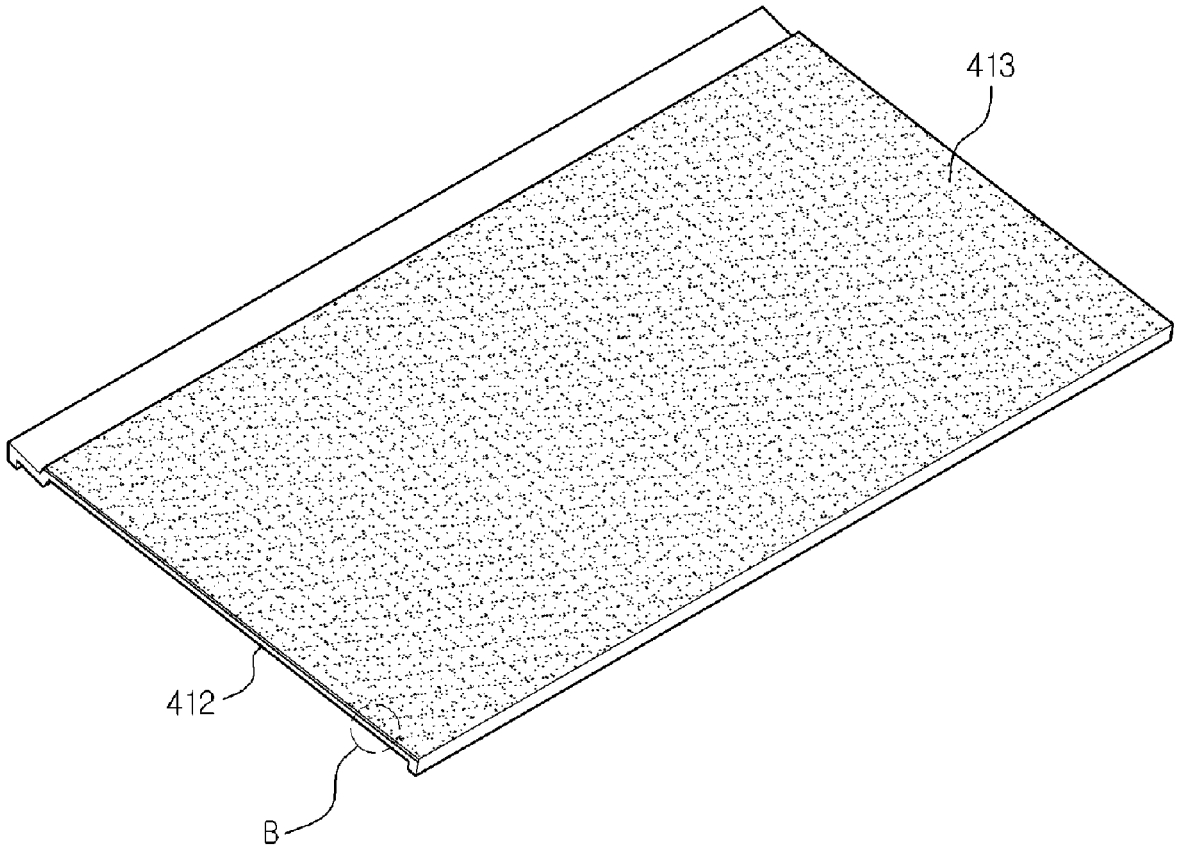
Figure 11B:
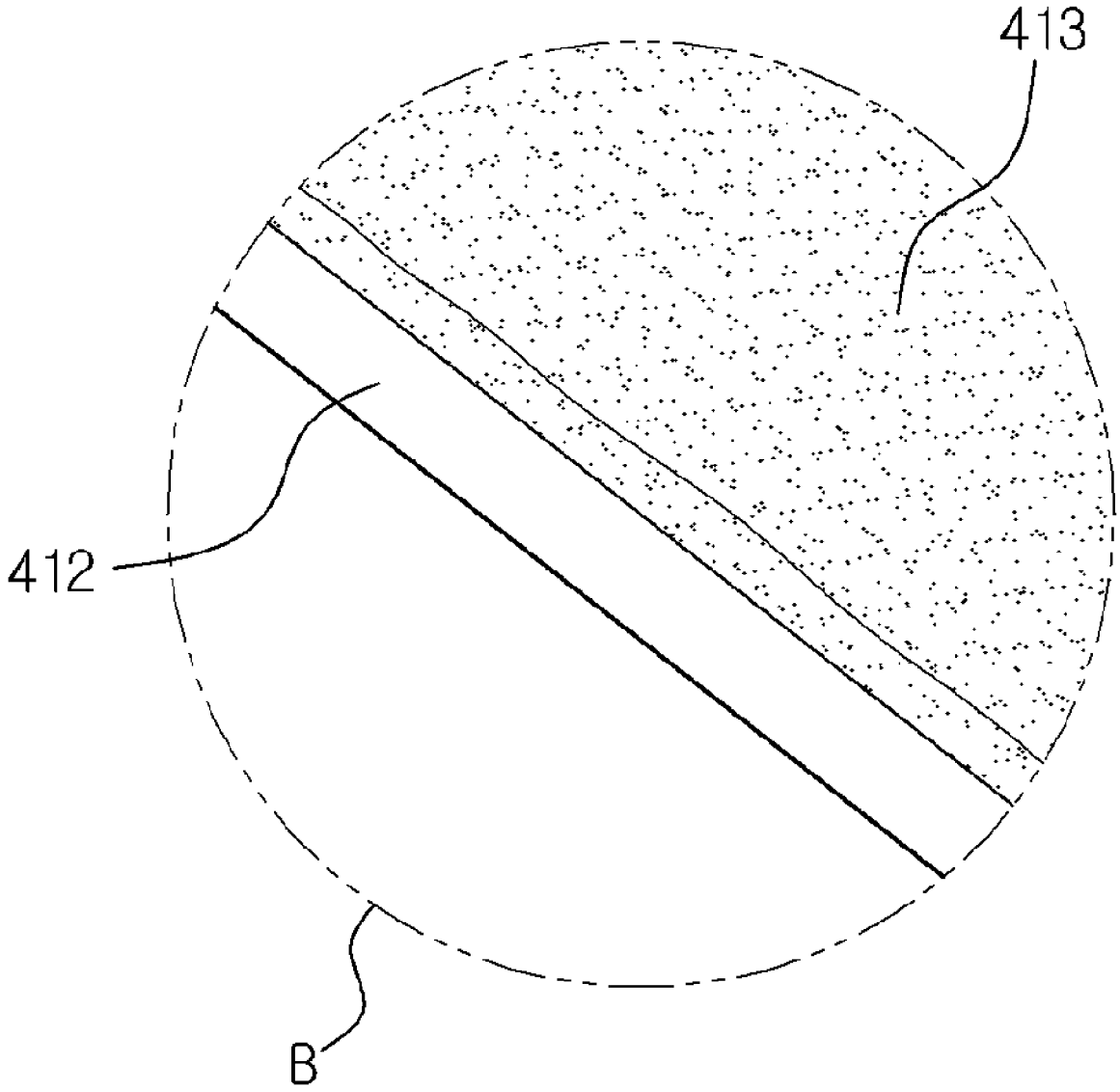
FIG. 11B is an exploded view illustrating detail "B" of FIG. 11A.

FIGS. 10, 11A, and 11B are perspective views illustrating different covers for the developing unit according to alternative exemplary embodiments of the present general inventive concept. For reference, FIG. 11B is an enlarged view of the detail "B" in FIG. 11A.

A cover 312 of the developing unit 100Y illustrated in FIG. 10 may be made of ABS material, and an anti-charge part 313, made of a conductive film, may be attached to the cover 312. The anti-charge part 313 may be grounded by a grounding member (not illustrated) in a state wherein the developing unit 100Y is mounted in the image forming apparatus 100. The anti-charge part 313 made of the conductive film according to the present exemplary embodiment may be fabricated via extrusion molding of a material prepared by adding carbon or a conductive filler to polyethylene, but the fabrication method of the anti-discharge part 313 is not specially limited thereto. The anti-charge part 313 of the present exemplary embodiment may be easily attached to a conventional cover without a structural change of the cover and may be fabricated via a simplified process. Also, although the anti-charge part 313 made of the conductive film according to the present exemplary embodiment is attached to an entire surface opposite the optical path L, the anti-charge part 313 having a shape corresponding to the optical path may be attached to the base frame 214.

An anti-charge part 413 illustrated in FIGS. 11A and 11B may be fabricated by coating a cover 412 of the developing unit 100Y with a conductive material. In this case, the conductive coating material may be carbon, Teflon, or the like, but the present exemplary embodiment is not limited thereto. The anti-charge part 413 may be grounded using a grounding member (not illustrated) in a state wherein the developing unit 100Y is mounted in the body 10 of the image forming apparatus 100. Of course, the conductive material may be coated over an entire surface opposite the optical path L as shown in FIG. 11A, or may be coated over the cover into a shape corresponding to a shape of the optical path L.

Figure 12:
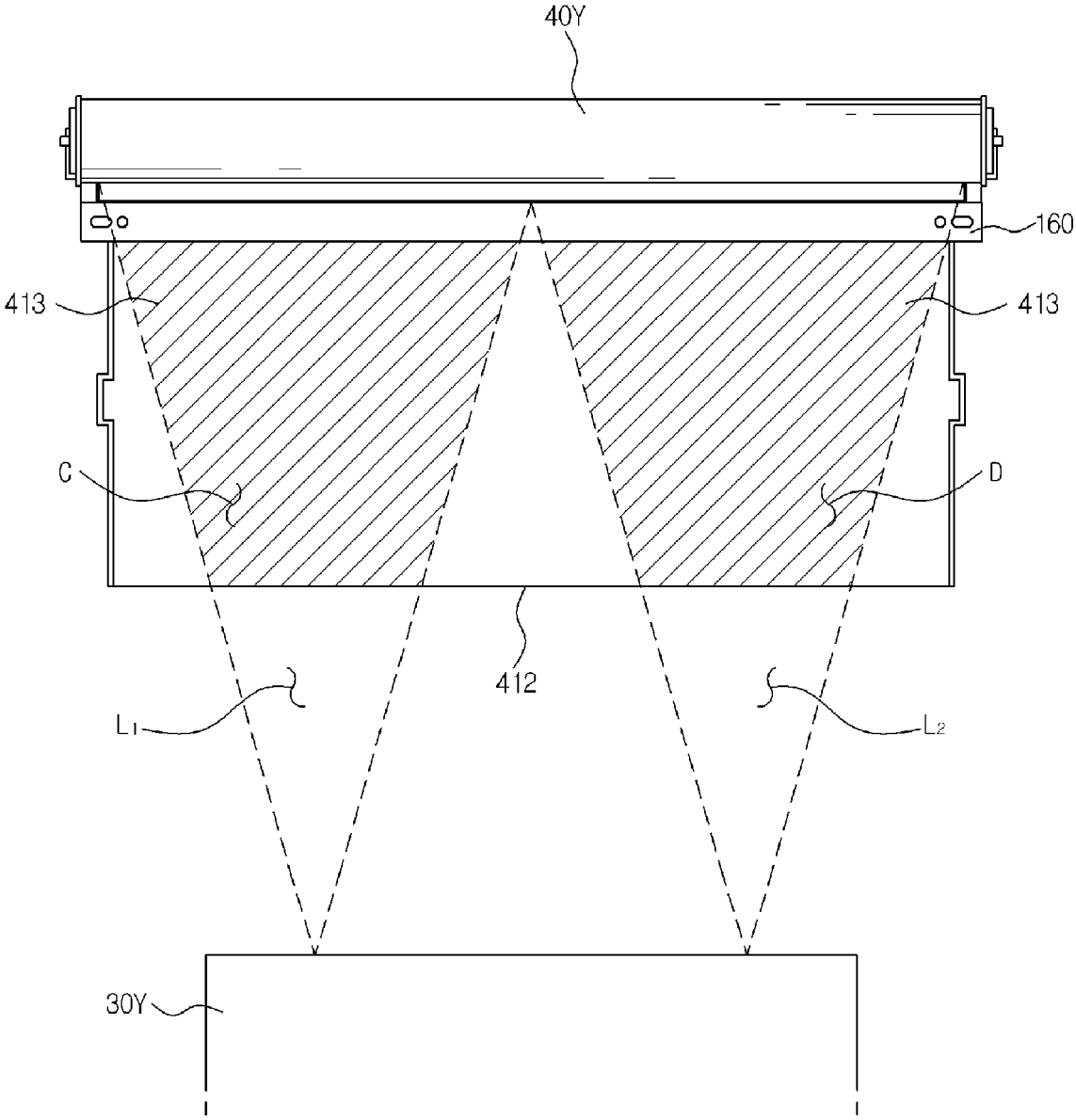
FIG. 12 is a top plan view illustrating optical paths of light scanned from a light scanning unit according to another exemplary embodiment of the present general inventive concept.

FIG. 12 is a top plan view illustrating optical paths of light scanned from a light scanning unit according to another exemplary embodiment.

Referring to FIG. 12, in alternative exemplary embodiments, light may be emitted from the light scanning unit 30Y in two different optical paths $L_1$ and $L_2$ and passes over first and second conductive member portions C and D, respectively. That is, the anti-charge part 413, made of a conductive member, may be formed only in the conductive portions C and D of the cover 412 which correspond to the different optical paths $L_1$ and $L_2$. In this case, the anti-charge part 413 may have an area sufficient to cover each of the two optical paths $L_1$ and $L_2$. Also, the anti-charge parts 413 corresponding to the first and second conductive member portions C and D may be grounded using a grounding member (not illustrated) in a state wherein the developing unit 100Y is mounted in a body 10 of an image forming apparatus 100.

In exemplary embodiments, the cover 412 may be disposed above the developer storage and feed regions of the developing unit 100Y. More specifically, the cover 412 or the conductive anti-charge part 413 provided on the cover 412 may be disposed between the optical paths $L_1$ and $L_2$, along which the light is introduced, and at least a part of, e.g., a belt device 141, a feed member 120 and a developing member 130 which function to feed the developer toward the photoconductor 40Y.

In addition, various other exemplary embodiments of the present general inventive concept may naturally be realized.

For example, the cover of the developing unit described herein is an exemplary member to have an effect on light scanning performance when impurities on the cover are charged, and the anti-charge part of the exemplary embodiments may be provided at other members rather than the cover of the developing unit thus serving to prevent the optical path from being intercepted by the impurities.

As is apparent from the above description, the exemplary embodiments of the present general inventive concept provide an image forming apparatus with an improved light scanning performance.

Although a few exemplary embodiments of the present general inventive concept have been shown and described, it would be appreciated by those skilled in the art that changes may be made in these exemplary embodiments without departing from the principles and spirit of the general inventive concept, the scope of which is defined in the claims and their equivalents.

What is claimed is:

1. An image forming apparatus comprising:

a light scanning unit to scan light containing information to be printed; and a developing unit comprising:

a photoconductor to which the light of the light scanning unit is scanned; and a developing frame to store developer and disposed adjacent to an optical path along which the light of the light scanning unit is radiated, wherein the developing frame includes a grounded conductive member.

2. The apparatus according to claim 1, wherein the conductive member is provided in the developing unit near the optical path along which the light is introduced.

3. The apparatus according to claim 1, wherein:

a region of the developing unit disposed below the optical path is provided with the developer or a developer feed member to feed the developer toward the photoconductor; and at least a part of the conductive member is located between the optical passage and the developer, or between the optical passage and the developer feed member in a direction of gravity.

4. The apparatus according to claim 1, wherein the conductive member is of at least one type selected from a plate, a film, a coating on the developing frame, and a conductive member formed on a part of the developing frame, or combinations thereof.

5. The apparatus according to claim 4, wherein the conductive member has a surface resistance of about $10e^{11}\Omega$ or less.

6. The apparatus according to claim 4, wherein the developing frame comprises:

a container to store the developer; and a cover to cover the top of the base frame and inclined by a predetermined angle.

7. The apparatus according to claim 6, wherein a shortest distance between the cover of the developing unit and an optical path of the light scanned from the light scanning unit is about 10 mm or less.

8. The apparatus according to claim 1, wherein the conductive member has a shape corresponding to a shape of an optical path of the light scanned from the light scanning unit.

9. The apparatus according to claim 1, further comprising a waste developer collecting unit to collect the developer remaining on the photoconductor, wherein the waste developer collecting unit is provided above the developing unit and the light scanned from the light scanning unit reaches the photoconductor via the optical passage defined between the waste developer collecting unit and the developing unit.

10. A developing unit provided in an image forming apparatus and serving to feed developer to a photoconductor, on which an electrostatic latent image is formed by light scanned from a light scanning unit, so as to form a visible image, the developing unit comprising:

a developing frame comprising a container to house the developer, and a cover to cover the container and disposed inclined with respect to the image forming apparatus; and a conductive member disposed on the developing frame to correspond to an optical path of the light scanned from the light scanning unit.

11. The unit according to claim 10, wherein the conductive member is provided at the cover.

12. The unit according to claim 10, wherein:

a region of the developing unit located under the optical path is provided with the developer or a developer feed member to feed the developer toward the photoconductor; and at least a part of the conductive member is located between the optical path and the developer, or between the optical path and the developer feed member in the direction of gravity.

13. The unit according to claim 10, wherein the conductive member is of at least one type selected from a plate, a film, a coating on the developing frame, and a conductive member formed on a part or an entirety of the developing frame, or combinations thereof.

14. The unit according to claim 13, wherein the conductive member is grounded.

15. The unit according to claim 10, wherein the conductive member has a shape corresponding to a shape of the optical path.

16. The unit according to claim 10, wherein the cover is inclined by a predetermined angle.

17. A developing device assembly provided in an image forming apparatus and serving to feed developer to a photoconductor, on which an electrostatic latent image is formed by light scanned from a light scanning unit, so as to form a visible image, the developing device assembly comprising:

a developing unit comprising:

a developing frame comprising a container to house the developer;

a cover to cover the top of the container and disposed inclined with respect to the image forming apparatus; and a conductive member disposed on developing frame and along an optical path of the light scanned from the light scanning unit; and a waste developer collecting unit to collect un-transferred developer remaining on the photoconductor.

18. The assembly according to claim 17, wherein the waste developer collecting unit is provided above the developing unit, and the light scanned from the light scanning unit reaches the photoconductor via an optical passage defined between the waste developer collecting unit and the developing unit.

19. A developing unit of an image forming apparatus having a photoconductor to receive light from a light scanning unit, the developing unit comprising:

a developing frame comprising a container to store developer;

a conductive portion disposed on the developing frame below an optical path between the light scanning unit and the photoconductor and to prevent impurities from interfering with the light of the light scanning unit; and a cover to cover the container and disposed inclined with respect to the image forming apparatus to allow gravity to move impurities disposed thereon away from the optical path.

20. The developing unit according to claim 19, wherein an area of the conductive portion corresponds to an area of the optical path.

21. A developing unit of an image forming apparatus having a photoconductor to receive first and second lights from a light scanning unit, the developing unit comprising:

a developing frame having a container to store developer; and first and second conductive portions disposed on the developing frame to respectively correspond to the first and second lights, wherein the first and second conductive portions are disposed to prevent impurities from interfering with the first and second lights of the light scanning unit.

22. The developing unit according to claim 21, wherein the first conductive portion is disposed below a first optical path of the first light between the light scanning unit and the photoconductor, and the second conductive portion is disposed below a second optical path of the second light between the light scanning unit and the photoconductor.

23. The developing unit according to claim 22, wherein the developing frame includes a cover to cover the container.

24. The developing unit according to claim 22, wherein the cover is inclined with respect to the image forming apparatus to allow gravity to move the impurities disposed thereon away from the first and second optical paths.

25. The developing unit according to claim 22, wherein an area of the first conductive portion corresponds to an area of the first optical path, and an area of the second conductive portion corresponds to an area of the second optical path.

* * * * *